US009789703B2

(12) United States Patent
Kodama

(10) Patent No.: US 9,789,703 B2
(45) Date of Patent: Oct. 17, 2017

(54) RECORDING DEVICE AND CURL DETERMINATION METHOD

(71) Applicant: SEIKO EPSON CORPORATION, Tokyo (JP)

(72) Inventor: Hidetoshi Kodama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/918,810

(22) Filed: Oct. 21, 2015

(65) Prior Publication Data

US 2016/0121625 A1 May 5, 2016

(30) Foreign Application Priority Data

Oct. 31, 2014 (JP) ..... 2014-223664
Oct. 31, 2014 (JP) ..... 2014-223665

(51) Int. Cl.

*B41J 11/00* (2006.01)
*B41J 2/175* (2006.01)
*B41J 25/308* (2006.01)
*B41J 13/00* (2006.01)

(52) U.S. Cl.

CPC ..... *B41J 11/0005* (2013.01); *B41J 2/17566* (2013.01); *B41J 13/0036* (2013.01); *B41J 25/3082* (2013.01); *B41J 25/3086* (2013.01)

(58) Field of Classification Search

CPC ..... B41J 11/0005; B41J 13/0036; B41J 25/3086; B41J 25/3082; B41J 2/17566
See application file for complete search history.

(56) References Cited

U.S. PATENT DOCUMENTS 5,714,990 A 2/1998 Courtney
5,787,331 A * 7/1998 Ohkuma ..... B41J 3/60 162/271
5,949,450 A 9/1999 Elley et al.
2009/0073211 A1* 3/2009 Imoto ..... B41J 11/0005 347/16
2009/0147039 A1* 6/2009 Koase ..... B41J 11/0005 347/16
2009/0201523 A1* 8/2009 Saito ..... B41J 3/60 358/1.9
2012/0162300 A1* 6/2012 Hirata ..... B41J 2/155 347/16
2013/0278654 A1* 10/2013 Ito ..... B41J 2/17566 347/6

FOREIGN PATENT DOCUMENTS

JP 08-230178 A 9/1996
JP 10-024560 A 1/1998

(Continued)

*Primary Examiner* — Bradley Thies
(74) *Attorney, Agent, or Firm* — Global IP Counselors, LLP

(57) ABSTRACT

There is provided a recording device including a transport section that transports paper along a support surface; a recording section; a determination region setting section; a liquid volume ratio calculation section; a determination section; and a recording position adjustment section that, when the determination section determines that the average value is larger than the threshold, adjusts a distance of the recording section from the support surface to a distance which is longer than a case in which the average value is not larger than the threshold.

6 Claims, 11 Drawing Sheets

(56) References Cited

FOREIGN PATENT DOCUMENTS

| | | | |
|---|---|---|---|
| JP | 11-227178 | A | 8/1999 |
| JP | 2001-158076 | A | 6/2001 |
| JP | 2006-150798 | A | 6/2006 |
| JP | 2008-183718 | A | 8/2008 |
| JP | 2009-143010 | A | 7/2009 |
| JP | 2009-214534 | A | 9/2009 |
| JP | 2012-139907 | A | 7/2012 |

* cited by examiner

| PAPER SIZE | | PAPER WIDTH (mm) | PAPER LENGTH (mm) | La (mm) | Lb (mm) | Lc (mm) | Ld (mm) |
|---|---|---|---|---|---|---|---|
| A6 | PORTRAIT | 105 | 148 | 3 | 3 | 33 | 47.33 |
| A5 | PORTRAIT | 148 | 210 | | | 47.33 | 68 |
| | LANDSCAPE | 210 | 148 | | | 68 | 47.33 |
| A4 | PORTRAIT | 210 | 297 | | | 68 | 97 |
| | LANDSCAPE | 297 | 210 | | | 12 | 12 |
| A3 | PORTRAIT | 297 | 420 | | | 97 | 138 |
| B5 | PORTRAIT | 176 | 250 | | | 56.67 | 81.33 |
| | LANDSCAPE | 250 | 176 | | | 12 | 12 |
| B4 | PORTRAIT | 250 | 352 | | | 81.33 | 115.33 |

FIG. 6A

TA

| RESOLUTION | PAPER SIZE | | THRESHOLD OF PRINTING DUTY (%) | | | | | |
|---|---|---|---|---|---|---|---|---|
| | | | LOW TEMPERATURE | | ROOM TEMPERATURE | | HIGH TEMPERATURE | |
| | | | LOW HUMIDITY | HIGH HUMIDITY | LOW HUMIDITY | HIGH HUMIDITY | LOW HUMIDITY | HIGH HUMIDITY |
| LOW | A6 | PORTRAIT | 9 | 19 | 19 | 19 | 19 | 19 |
| | A5 | PORTRAIT | 9 | 19 | 19 | 19 | 19 | 19 |
| | | LANDSCAPE | 9 | 19 | 19 | 19 | 19 | 28 |
| | A4 | PORTRAIT | 9 | 19 | 19 | 19 | 19 | 28 |
| | B5 | PORTRAIT | 9 | 19 | 19 | 19 | 19 | 28 |
| HIGH | A6 | PORTRAIT | 8 | 16 | 16 | 16 | 16 | 16 |
| | A5 | PORTRAIT | 8 | 16 | 16 | 16 | 16 | 16 |
| | | LANDSCAPE | 8 | 16 | 16 | 16 | 16 | 24 |
| | A4 | PORTRAIT | 8 | 16 | 16 | 16 | 16 | 24 |
| | B5 | PORTRAIT | 8 | 16 | 16 | 16 | 16 | 24 |

FIG. 6B

TB

| RESOLUTION | PAPER SIZE | | THRESHOLD OF PRINTING DUTY (%) | | | | | |
|---|---|---|---|---|---|---|---|---|
| | | | LOW TEMPERATURE | | ROOM TEMPERATURE | | HIGH TEMPERATURE | |
| | | | LOW HUMIDITY | HIGH HUMIDITY | LOW HUMIDITY | HIGH HUMIDITY | LOW HUMIDITY | HIGH HUMIDITY |
| LOW | A4 | LANDSCAPE | 7 | 12 | 15 | 16 | 17 | 30 |
| | A3 | PORTRAIT | 6 | 11 | 14 | 15 | 16 | 29 |
| | B5 | LANDSCAPE | 7 | 12 | 15 | 16 | 17 | 30 |
| | B4 | PORTRAIT | 6 | 11 | 14 | 15 | 16 | 29 |
| HIGH | A4 | LANDSCAPE | 6 | 11 | 14 | 15 | 16 | 29 |
| | A3 | PORTRAIT | 5 | 10 | 13 | 14 | 15 | 28 |
| | B5 | LANDSCAPE | 6 | 11 | 14 | 15 | 16 | 29 |
| | B4 | PORTRAIT | 5 | 10 | 13 | 14 | 15 | 28 |

FIG. 7A

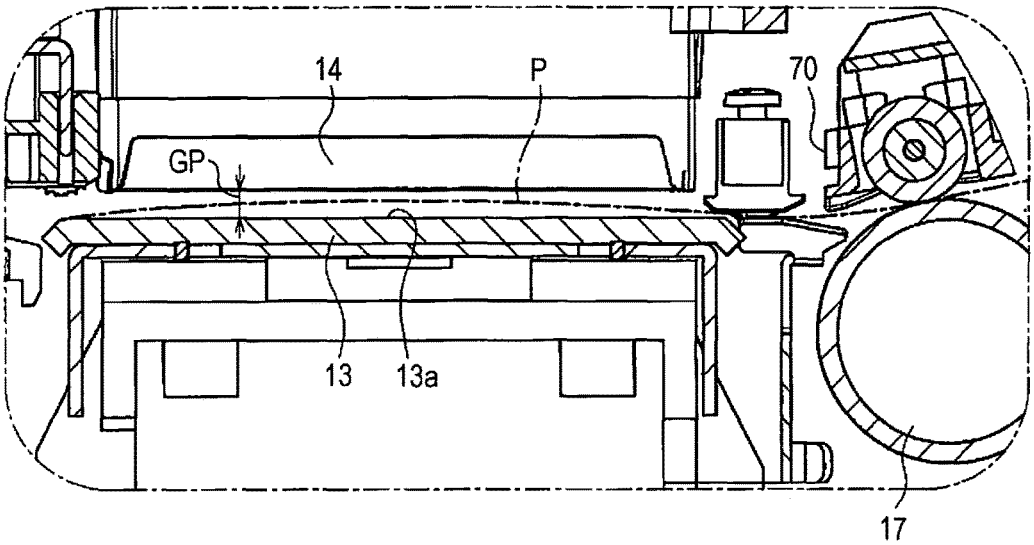

FIG. 7B

| RESOLUTION | PAPER | PRINTING DUTY | DISTANCE OF RECORDING SECTION FROM SUPPORT SURFACE |
|---|---|---|---|
| LOW | THIN | SMALLER THAN THRESHOLD | 1.3 mm |
| | | EQUAL TO OR LARGER THAN THRESHOLD | 2 mm |
| | THICK | SMALLER THAN THRESHOLD | 1.5 mm |
| | | EQUAL TO OR LARGER THAN THRESHOLD | 2.2 mm |
| HIGH | THIN | SMALLER THAN THRESHOLD | 1.5 mm |
| | | EQUAL TO OR LARGER THAN THRESHOLD | 2.2 mm |
| | THICK | SMALLER THAN THRESHOLD | 1.5 mm |
| | | EQUAL TO OR LARGER THAN THRESHOLD | 2.2 mm |

| PAPER SIZE | | DRYING TIME (SECOND) | | | | | |
|---|---|---|---|---|---|---|---|
| | | LOW TEMPERATURE | | ROOM TEMPERATURE | | HIGH TEMPERATURE | |
| | | LOW HUMIDITY | HIGH HUMIDITY | LOW HUMIDITY | HIGH HUMIDITY | LOW HUMIDITY | HIGH HUMIDITY |
| A6 | PORTRAIT | 20 | 15 | 15 | 15 | 5 | 1 |
| A5 | PORTRAIT | | | | | | |
| | LANDSCAPE | | | | | | |
| A4 | PORTRAIT | | | | | | |
| | LANDSCAPE | | | | | | |
| A3 | PORTRAIT | | | | | | |
| B5 | PORTRAIT | | | | | | |
| | LANDSCAPE | | | | | | |
| B4 | PORTRAIT | | | | | | |

RECORDING DEVICE AND CURL DETERMINATION METHOD

BACKGROUND

1. Technical Field

The present invention relates to a recording device which includes a recording section that performs recording on a medium and a curl determination method for determining the generation of curls in a medium such as paper.

2. Related Art

In the related art, as one kind of a recording device, an ink jet type printer is known that includes a recording section which performs recording on sheet-shaped paper, which is an example of a medium, and that performs printing (recording) of an image on the paper by discharging ink as a liquid (recording liquid) to the paper, which is supported and transported to a support pedestal, from the recording section. In such a printer, there is a phenomenon in which paper curls due to ink which is discharged to and adheres to the paper.

In particular, in a printer in which the recording section includes a liquid discharge head (recording head) that is capable of simultaneously discharging ink over the paper in the transport direction and in the width direction, which is perpendicular to the transport direction, ink adheres over the entirety of the paper in the width direction substantially at the same time, and thus the liquid volume of the ink which adheres to the paper in a short time increases. In addition, in accordance that printing time becomes short, a drying time of a large amount of liquid, which adheres to a recording region, becomes short. For these reasons, the paper is in a state in which it tends to become curled. As a result, the curled paper comes into contact with the liquid discharge head in the middle of transport, and thus friction may be generated. Further, when friction is generated between the paper and the liquid discharge head, there is a problem in which it is difficult to print a high-quality image on the paper.

Therefore, in the related art, a recording device is provided that calculates (detects) the total liquid volume of ink (total amount of ink) which adheres to paper based on the image data of a printing image on the whole paper (medium), that is, based on ink (liquid) discharge data, and that adjusts a gap between a liquid discharge head (recording section) and the paper based on the calculated total liquid volume of the ink, and a recording device is provided that detects the curl (wave) of paper based on calculated total liquid volume of ink (for example, refer to JP-A-2006-150798).

However, it is found that, when the total liquid volume of ink to be discharged to the whole paper is large, there is a case in which the degree of curls is low, that is, the quantity of curves (the amount of curls) of the paper is small in the actual curled paper according to the regions to which the ink adheres. In this manner, when the actual amount of curls is small, originally, it is not necessary to cause the recording section to retreat such that the recording section keeps away from the support pedestal and does not come into contact with the paper. However, in the recording device according to the related art, the recording section goes away from the support pedestal. As a result, deviation of the ink, discharged from the recording section which goes away, from an impact position to the paper increases in accordance with the increased distance from the recording section to the paper. Therefore, there is a problem in that it is difficult to record a high-quality image on the paper. In addition, when the actual amount of curls is small, originally, paper is smoothly transported along the medium transport path without increasing a dryness degree. However, in the recording device according to the related art, there may be a case in which unnecessary drying is performed in order to increase the dryness degree of the paper.

Meanwhile, such a situation is generally common to a recording device that includes a transport section which transports a medium along a medium transport path, and a recording section which performs recording on the medium by discharging liquid and causing the liquid to adhere to the recording region of the medium which is transported by the transport section.

SUMMARY

An advantage of some aspects of the invention is to provide a recording device which is capable of recording a high-quality image on a medium by appropriately preventing friction between a transported medium and a recording section. In addition, another advantage of some aspects of the invention is to provide a curl determination method which is capable of accurately determining whether or not curls are actually generated in the medium. In addition, a further advantage of some aspects of the invention is to provide a recording device which is capable of smoothly transporting the medium along a medium transport path by appropriately drying the medium according to the curl, which is actually generated in the medium, which is accurately determined by the curl determination method.

Hereinafter, means of the invention and the operation effects thereof will be described.

According to an aspect of the invention, there is provided a recording device including: a support pedestal that supports a medium which has four side edges on a support surface; a transport section that transports the medium along the support surface; a recording section that performs recording on the medium by discharging liquid corresponding to a liquid volume based on discharge data to a recording region of the medium, which is transported by the transport section and causing the liquid to adhere to the medium; a determination region setting section that divides the recording region into a plurality of regions, and sets a continuous region, in which the plurality of regions are continued, as a determination region, the plurality of regions including an end part region which is the closest region to a corner section, in which two side edges are connected, of the medium; a liquid volume ratio calculation section that calculates an average value of liquid volume ratios of the liquid, which is discharged from the recording section to the determination region based on the discharge data, to the maximum liquid volume of the liquid which is capable of being discharged from the recording section; a determination section that determines whether or not the average value of the liquid volume ratios, which are calculated for the determination region, is larger than a predetermined threshold; and a recording position adjustment section that, when the determination section determines that the average value is larger than the threshold, adjusts the distance from the support surface of the recording section to a distance which is longer than in a case in which the average value is not larger than the threshold.

According to the aspect, the liquid volume ratios of the continuous regions, which include the end part region that is close to the corner section in the recording region, have a strong correlation with the generation of the curls, and thus it is possible to accurately determine the generation of the curl by acquiring the average value of the liquid volume ratios while it is assumed that the continuous region as the determination region. As a result, friction between the medium, which is transported according to the accurately determined generation of the curl, and the recording section is appropriately prevented, and thus it is possible to record a high-quality image on the medium.

In the recording device, it is preferable that the determination region setting section sets the plurality of determination regions in the recording region of the medium, and the determination section determines whether or not the largest average value of the average values of the liquid volume ratios of the liquid, which is discharged to the plurality of determination regions, is larger than the threshold.

According to the aspect, a part of the region, which has the largest average value of the liquid volume ratios, of the determination regions, which include the end part region, in the recording region has a strong correlation with the generation of the curl, and thus it is possible to accurately determine the generation of the curl based on the largest average value of the liquid volume ratios of the determination regions.

In the recording device, it is preferable that the determination region is a region which is positioned in a fixed distance from the side edges in the recording region.

According to the aspect, the liquid volume ratios of the determination regions in the fixed distance from the side edges of the medium in the recording region have a strong correlation with the generation of the curl, and thus it is possible to accurately determine the generation of the curl based on the average value of the liquid volume ratios of the determination regions in the fixed distance from the side edges of the medium.

In the recording device, it is preferable that the determination region setting section sets the determination regions such that the determination regions reach over the center of the one side edges from the side of the corner section along at least one of the side edges.

According to the aspect, the liquid volume ratios of the determination regions have a strong correlation with the generation of the curl by setting the determination region up to the region which reaches over the center of the side edge of the medium, and thus it is possible to accurately determine the generation of the curl based on the average value of the liquid volume ratios of the determination regions.

It is preferable that the recording device further includes a temperature and humidity detection section that detects temperature and humidity of the medium acquired before the recording is performed, and the determination section performs determination by using the threshold which is predetermined according to the detected temperature and humidity of the medium.

According to the aspect, the temperature and the humidity have a strong correlation with the generation of the curl in the recording region, and thus it is possible to accurately determine the generation of the curl according to the detected temperature and humidity of the medium.

According to another aspect of the invention, there is provided a curl determination method including dividing a recording region of a medium, which includes four side edges, into a plurality of regions, and setting a continuous region, in which the plurality of regions are continued, as a determination region, the plurality of regions including an end part region which is the closest region to a corner section, in which two side edges are connected, of the medium; calculating an average value of liquid volume ratios of the liquid, which is discharged from the recording section to the determination region based on the discharge data of the liquid which is discharged from a recording section to the medium, to the maximum liquid volume of liquid which is capable of being discharged from the recording section; and determining whether or not the average value of the liquid volume ratios, which are calculated for the determination region, is larger than a predetermined threshold, and determines that curls are generated in the medium when it is determined that the average value is larger than the threshold.

In the method, the liquid volume ratios of the continuous regions, which include the end part region that is closest to the corner section in the recording region, of the medium have a strong correlation with the curl, and thus it is possible to accurately determine the generation of the curl by assuming that the continuous region as the determination region and by using the average value of the liquid volume ratios.

In the curl determination method, it is preferable that the dividing and setting includes setting the plurality of determination regions in the recording region of the medium, and the determining includes determining whether or not the largest average value of the average values of the liquid volume ratios of the liquid, which is discharged to the plurality of determination regions, is larger than the threshold.

In the method, a region part corresponding to the largest liquid volume ratio of the determination region which includes the end part region in the recording region has a strong correlation with the curl, and thus it is possible to accurately determine the generation of the curl by comparing the largest average value of the liquid volume ratios of the determination regions with the threshold.

In the curl determination method, it is preferable that the determination region is a region which is positioned in a fixed distance from the side edges in the recording region.

In the method, the liquid volume ratios of the determination regions in the fixed distance from the side edges of the medium in the recording region have a strong correlation with the generation of the curl, and thus it is possible to accurately determine the generation of the curl based on the average value of the liquid volume ratios of the determination regions in the fixed distance from the side edges of the medium.

In the curl determination method, it is preferable that the dividing and setting includes setting the determination region such that the determination region reaches over the center of the one side edge from the corner section side along at least one of the side edges.

According to the aspect, when the determination regions are set up to the region which reaches over the center of the side edges of the medium, and thus the liquid volume ratios of the determination regions have a strong correlation with the generation of the curl. Therefore, it is possible to accurately determine the generation of the curl based on the average value of the liquid volume ratios of the determination regions.

It is preferable that the curl determination method further includes detecting temperature and humidity of the medium acquired before the recording is performed, and the determining includes performing determination by using the threshold which is predetermined according to the detected temperature and humidity of the medium.

According to the aspect, the temperature and the humidity in the recording region have a strong correlation with the generation of the curl degree, and thus it is possible to accurately determine the generation of the curl based on the detected temperature and humidity of the medium.

According to another aspect of the invention, there is provided a recording device including a transport section that transports a medium, which has four side edges, along a medium transport path; a recording section which performs recording on the medium by discharging liquid corresponding to a liquid volume based on discharge data to a recording region of the medium, which is transported by the transport section, and causing the liquid to adhere to the medium; a determination section that determines whether or not curls are generated in the medium by using the curl determination method according to the aspect; and a dryness degree adjustment section that, when the determination section determines that the curl is generated, performs adjustment such that the medium, which is transported by the medium transport section, is dried at a higher dryness degree than in a case in which it is determined that the curl is not generated.

According to the aspect, the liquid volume ratio of the continuous region, which includes the end part region in the recording region, has a strong correlation with the curl, and thus it is possible to accurately determine the generation of the curl based on the average value of the liquid volume ratios by assuming that the continuous region is the determination region. As a result, when the medium is appropriately dried according to the curl which is actually generated in the medium, it is possible to smoothly transport the medium along the medium transport path.

In the recording device, it is preferable that the dryness degree adjustment section adjusts the dryness degree of the medium by adjusting a transport speed of the medium which is transported by the transport section.

According to the aspect, it is possible to dry the medium at a dryness degree according to the amount of curls actually generated in the medium without additionally providing a heating device such as a heater.

In the recording device, it is preferable that, when the transport section successively transports a plurality of media, the determination section determines whether or not the curls are generated for each of the plurality of media which are transported along the medium transport path; and the dryness degree adjustment section adjusts the transport speed of the media, which are transported by the transport section, according to each of the plurality of media.

According to the aspect, when the transport speed on the medium transport path is adjusted according to curls which are respectively generated in the plurality of media, it is possible to dry the media at the dryness degrees according to the curls which are generated in the media.

In the recording device, it is preferable that, when the transport section successively transports the plurality of media, the transport section adjusts the transport speed of the medium such that a previously transported medium does not come into contact with a subsequently transported medium on the medium transport path.

According to the aspect, it is possible to prevent the quality of an image or the like, which is recorded on the medium, from being deteriorated due to contact, on the medium transport path.

BRIEF DESCRIPTION OF THE DRAWINGS

The invention will be described with reference to the accompanying drawings, wherein like numbers reference like elements.

FIGS. 6A and 6B are diagrams illustrating a threshold table of the liquid volume ratios which are set in the determination regions.

FIG. 7A is a schematic diagram illustrating a recording section which is adjusted to a position which is separated from a support surface.

FIG. 7B is a diagram illustrating a distance table in which distances from the support surface, in which the recording section is positioned, are set.

DESCRIPTION OF EXEMPLARY EMBODIMENTS

Hereinafter, as an example of a recording device according to an embodiment, an ink jet type printer that includes a recording section for discharging ink, which is an example of liquid, and that prints (records) an image which includes letters and patterns by discharging ink to the paper, which is an example of a sheet-shaped medium, with reference to the accompanying drawings.

Figure 1:
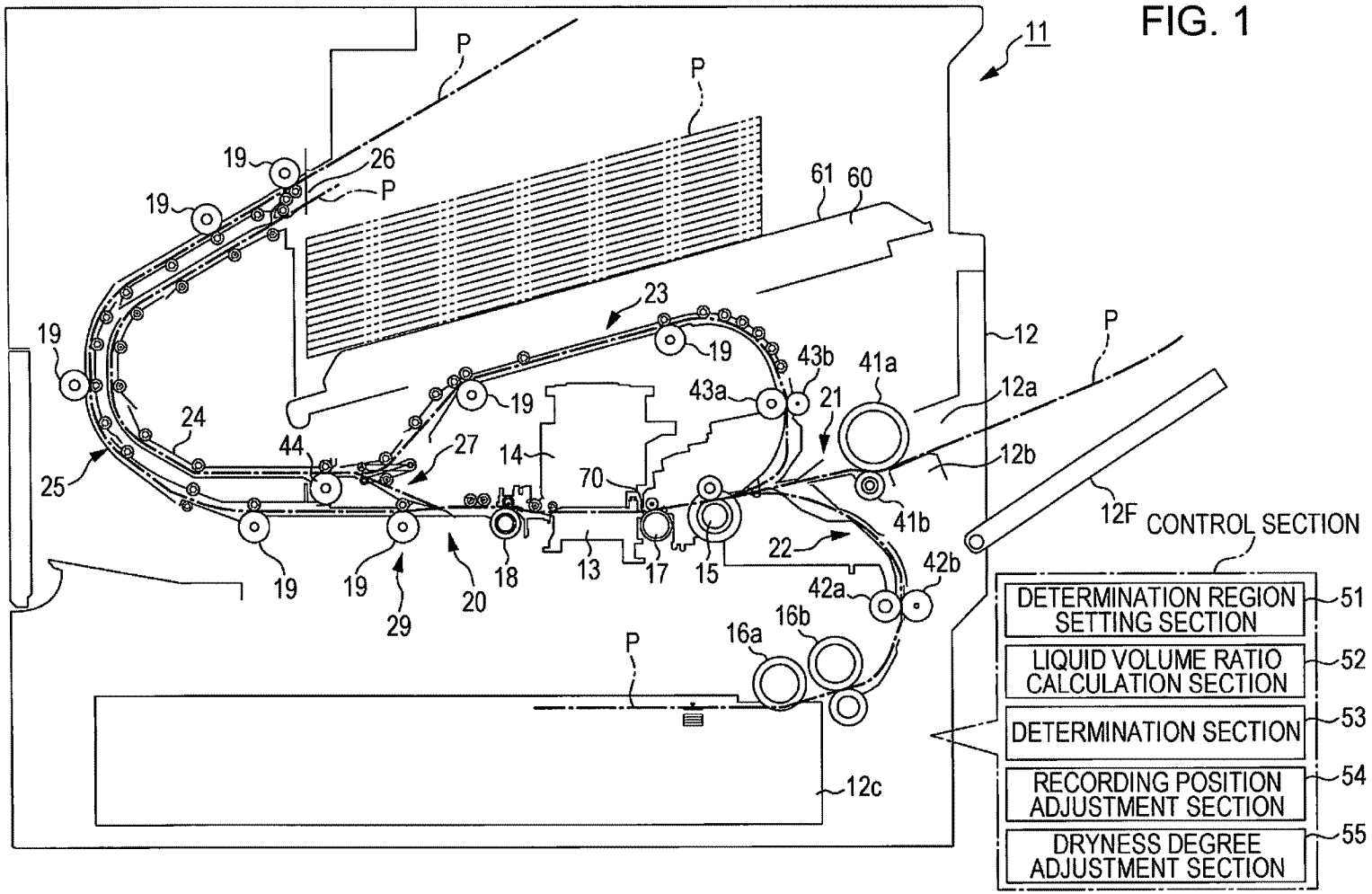
FIG. 1 is a structural diagram schematically illustrating a printer as an example of a recording device according to an embodiment.

As illustrated in FIG. 1, a printer 11 as the example of the recording device according to the embodiment include, in a substantially rectangular-shaped housing 12, includes a support pedestal 13 which supports paper P from a side of a gravity direction, a recording section 14 which prints an image on the paper P, and a medium transport path 20 through which the paper P is transported. In addition, the printer 11 further includes a transport section 29 which includes a plurality of rollers (a pair of rollers) and transports the paper P along the medium transport path 20.

The printer 11 transports the paper P over the support pedestal 13 along the medium transport path 20 while setting the direction of the front and rear sides of paper in FIG. 1 to the width direction of the paper P and setting a direction which is perpendicular to the width direction to a transport direction. The recording section 14 includes a line head at a lower part as a liquid discharge head, which is capable of simultaneously discharging ink on substantially the whole region of the paper P in the transport direction and in the width direction, which is perpendicular to the transport direction, and prints an image by causing the ink to adhere to the paper P, which is transported over the support pedestal 13, from the antigravity direction.

The printed paper P is transported from the recording section 14 to the medium transport path 20 by a pair of paper ejection rollers 18 or a plurality of other pair of transport rollers 19, and is emitted to the outside of the medium transport path 20 from the medium outlet 26 which is provided at the end part of the medium transport path 20. As illustrated by a two-dot chain line in FIG. 1, the emitted paper P is mounted on the mounting surface 61 of a mounting pedestal 60 in a laminated state.

In the embodiment, the medium transport path 20 includes a medium ejection path 25 which transports the paper P from the recording section 14 to the medium outlet 26, and a medium supply path which supplies the paper P to the recording section 14. The medium supply path includes a first medium supply path 21, a second medium supply path 22, and a third medium supply path 23.

In the first medium supply path 21, the paper P which is inserted from an insertion opening 12*a*, which is exposed when a cover 12F provided on one side surface of the housing 12 is open, is transported to the recording section 14. That is, the paper P, which is inserted into the insertion opening 12*a*, is pushed to a first driving roller 41*a* by a hopper 12*b*, is transported through rotation driven by the first driving roller 41*a*, is interposed between the first driving roller 41*a* and a first following roller 41*b*, and is transported toward the recording section 14 through rotation driven by the first driving roller 41*a*.

In the second medium supply path 22, the paper P, which is mounted in a laminated manner on a paper cassette 12*c* that is provided at the bottom on the gravity direction side of the housing 12, is transported to the recording section 14. That is, the upper-most paper P of the paper P, which is mounted on the paper cassette 12*c* in a laminated state, is sent by a pick-up roller 16*a*, separated one by one by a pair of separation rollers 16*b*, interposed between the second driving roller 42*a* and the second following roller 42*b*, and transported toward the recording section 14 through rotation driven by the second driving roller 42*a*.

In the third medium supply path 23, when duplex printing is performed on both-side sheet surfaces of the paper P (paper surface), the paper P, in which one side of a sheet surface is completely printed by the recording section 14, is transported to the recording section 14 again. That is, on the downstream side of the paper P rather than the recording section 14 in the transport direction, a branched transport path 24 is provided which branches from the medium ejection path 25 due to the operation of a branching mechanism 27 which is provided in the middle of the medium ejection path 25. On the branched transport path 24, a pair of branched transport path rollers 44, which are capable of performing rotation in both directions, that is, rotation in the normal direction and in the reverse direction, are provided on the downstream side of the branching mechanism 27.

The paper P, in which one side of the sheet surface is printed, is transported once to the branched transport path 24 toward the side of the mounting pedestal 60 from the side of the recording section 14 by the pair of branched transport path rollers 44 and the plurality of transport rollers 19 which rotate in the normal direction when the duplex printing is performed. Thereafter, the pair of branched transport path rollers 44 rotate in the reverse direction, and thus the paper P is transported in the reverse direction through the branched transport path 24 from the side of the mounting pedestal 60 to the side of the recording section 14. At this time, the paper P, which is transported in the reverse direction, is transported to the third medium supply path 23, and is transported toward the recording section 14 by a plurality of pair of transport rollers 19. When transport to the third medium supply path 23 is performed, the paper P is reversed such that a sheet surface which is not printed to face the recording section 14, interposed between the third driving roller 43*a* and the third following roller 43*b*, and transported toward the recording section 14 through rotation driven by third driving roller 43*a*.

The paper P, which is transported such that each of the medium supply paths faces toward the recording section 14, is transported to a pair of alignment rollers 15 which are arranged on the upper stream side of the recording section 14 in the transport direction, and the tip of the paper comes into contact with the pair of alignment rollers 15 which stops rotation. Further, the inclination of the paper P for the transport direction is corrected (skewing is removed) by being in a state of coming into contact with the pair of alignment rollers 15. Further, the paper P, in which inclination is corrected, is in the alignment state and then transported to the side of the recording section 14 through rotation driven by the pair of alignment rollers 15 thereafter.

The paper P, which is transported to the side of the recording section 14 by the pair of alignment rollers 15, is transported while facing the recording section 14 by a pair of paper feeding rollers 17 which is installed on the upper stream side of the transport direction of the paper P for the recording section 14, a pair of paper ejection rollers 18 which is installed on the downstream side of the transport direction, and the pair of transport rollers 19. Printing is performed in such a way that ink is discharged to the transported paper P from the facing recording section 14 based on the discharge data.

The printer 11 includes a control section that has a computer function, and a storage section that stores a program which controls the printing operation and that is not shown in the drawing. Further, when the control section operates according to the program which is stored in the storage section, the operations of the recording section 14 and the transport section 29 are controlled based on the printing data which is input to the printer 11, and an image is printed (recorded) in a printing region E (refer to FIG. 4A) as the recording region of the paper P.

Figure 2A:
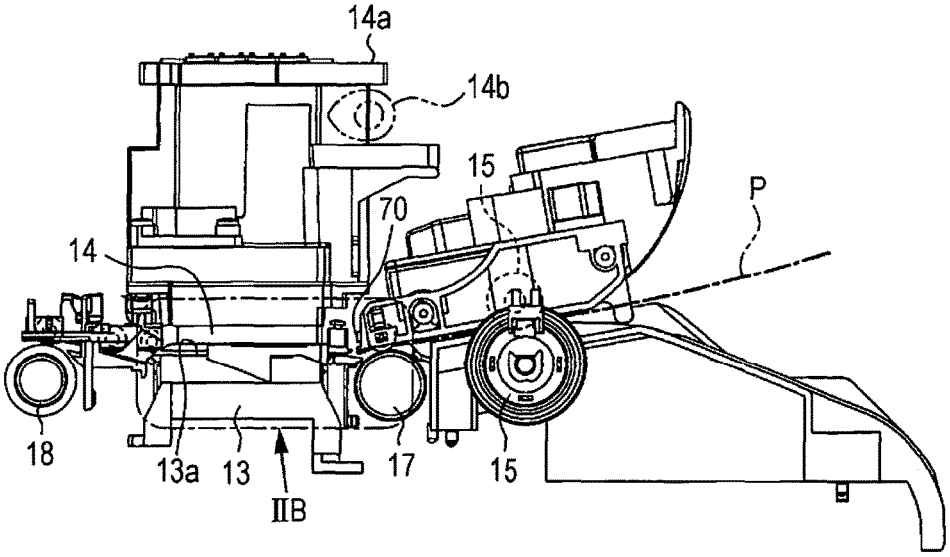
FIG. 2A is a partial schematic diagram illustrating a peripheral recording section which is provided in the printer.
Figure 2B:
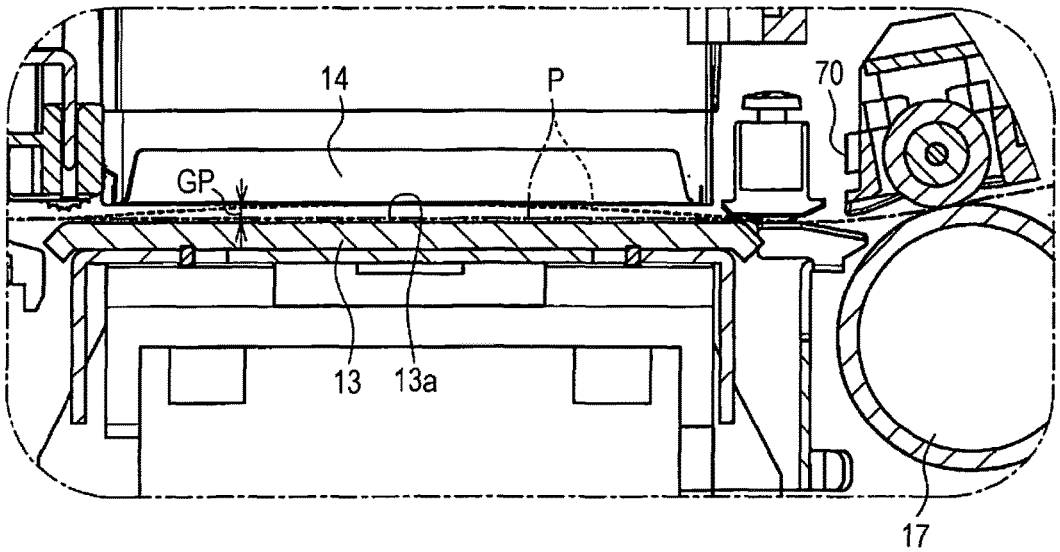
FIG. 2B is an enlarged diagram illustrating a partial cross section of a part illustrated with reference to symbol IIB in FIG. 2A.

As illustrated in FIGS. 2A and 2B, in the printer 11 according to the embodiment, a movement mechanism (lifting mechanism) is provided which is capable of adjusting the distance from the support surface 13*a* of the support pedestal 13 to the recording section 14 (liquid discharge head) in such a way that the recording section 14 moves in the vertical direction in the printing operation.

For example, as illustrated by a two-dot chain line in FIG. 2A, it is possible to provide a rotational eccentric cam 14*b* as the movement mechanism that includes a cam mechanism in which a part of the holding body 14*a* for holding the liquid discharge head is used as a cam follower for the eccentric cam 14*b*, and a driving source, such as a motor, which causes the eccentric cam 14*b* to rotate and which is not shown in the drawing.

The movement mechanism prints a high quality image on the paper P. Therefore, when ink is discharged from the recording section 14 to the paper P, dispersion of the impact positions (adhere positions) of ink should be prevented. Therefore, normally, the position of the recording section 14 is adjusted to be in a state in which a distance GP from the support surface 13*a* of the recording section 14, that is, the gap between the liquid discharge head and the support surface 13*a* is small.

In contrast, as illustrated by a broken line in FIG. 2B, when ink, which is discharged from the recording section 14, adheres to the paper P, there is a case in which the paper P has a recording surface side which expands in the printing region E to which the ink adheres. Due to the expansion, curls are generated in such a way that the recording surface side grows and becomes an convex surface. As a result, there is a problem in that the paper P (recording surface) is scraped by the liquid discharge head, or, when the paper P, which is printed by the recording section 14, is transported along the medium transport path 20, the paper P is not smoothly transported on the medium ejection path 25 and becomes jammed.

Here, in the printer 11 according to the embodiment, when a printing process is performed on the paper P, the position of the recording section 14 is adjusted according to the curls which are actually generated in the paper P. Otherwise, the medium is dried at a dryness degree according to the amount of actually generating curl of the medium. Meanwhile, the amount of curls generated in the paper P depends on the temperature and the humidity of the paper P before printing is performed. Here, in the embodiment, a temperature and humidity detection section 70, which detects the temperature and the humidity in the vicinity of the paper P transported by the pair of paper feeding rollers 17, is provided in the printer 11 (refer to FIGS. 1, 2A, and 2B).

An operation performed by the printer 11, that is, a process of dealing with the curls of the paper P, which is performed when printing is performed, will be described with reference to FIG. 3. Meanwhile, the process is performed in such a way that the control section, which controls the printing operation of the printer 11, determines whether or not the curls are generated in the paper P according to a prescribed program, and appropriately controls the movement mechanism of the recording section 14 or the operation of the transport section 29 according to the result of the determination.

That is, in the process of dealing the curls, the control section functions as a determination region setting section 51 that sets determination regions for determining the generation of curls, a liquid volume ratio calculation section 52 that calculates a liquid volume ratio for the set determination regions, and a determination section 53 which determines the generation of the curls. In addition, the control section functions as a recording position adjustment section 54 that adjusts the position of the recording section 14 by controlling the movement mechanism, and a dryness degree adjustment section 55 that adjusts the dryness degree of the paper P by controlling the transport section 29 and drying ink adheres to the paper P (refer to FIG. 1). Meanwhile, the liquid volume ratio is a liquid volume ratio of the ink, which is discharged from the recording section 14 based on the discharge data included in the printing data, to the maximum liquid volume of the ink which can be discharged from the recording section 14 (for example, an amount which is necessary to completely fill division regions as the determination regions which will be described later).

Figure 3:
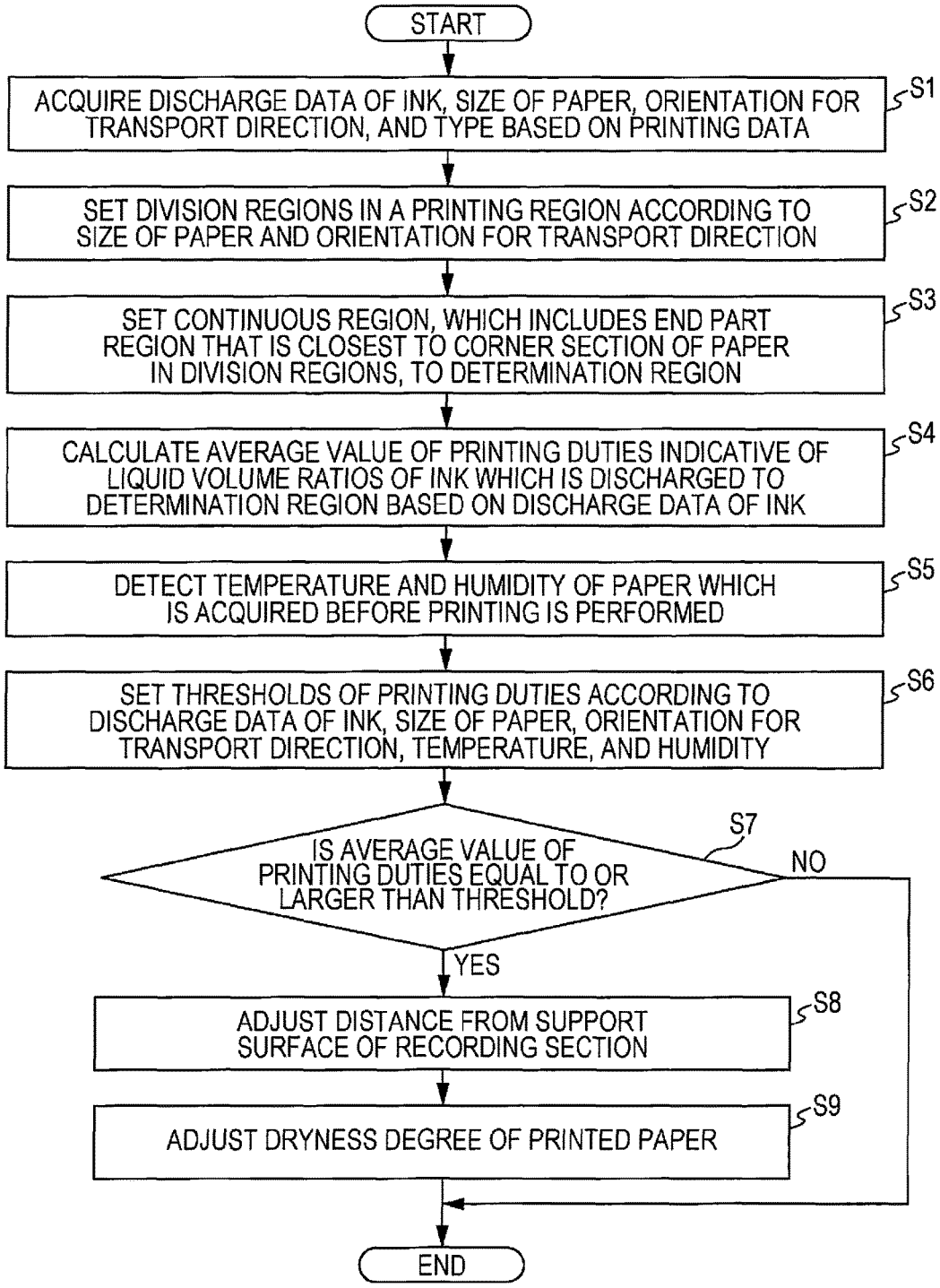
FIG. 3 is a flowchart illustrating an operation relevant to a printing process in the printer according to the embodiment.

As illustrated in FIG. 3, when the process starts, first, in step S1, a process of acquiring the discharge data of ink, the size of the paper P which is transported toward the recording section 14, the orientation of the paper P for the transport direction, and the type of the paper P based on the printing data is performed. The orientation of the paper P for the transport direction, which is acquired here, is data in which the length of the paper P along the transport direction is longer than the length of the width direction is set to "portrait" and the opposite case is set to "landscape". Further, in step S1, the control section acquires the attribute data (for example, the landscape of A4) of the paper P in which the size of the paper P is combined with the orientation of the paper P for the transport direction.

Subsequently, in step S2, the division region of the printing region is set with reference to a setting table, which is stored in the storage section, according to the size of the paper P and the orientation for the transport direction, which are acquired, that is, the attribute data of the paper P.

A process in step S2 will be described with reference to FIGS. 4A and 4B.

Figures 4A, 4B:
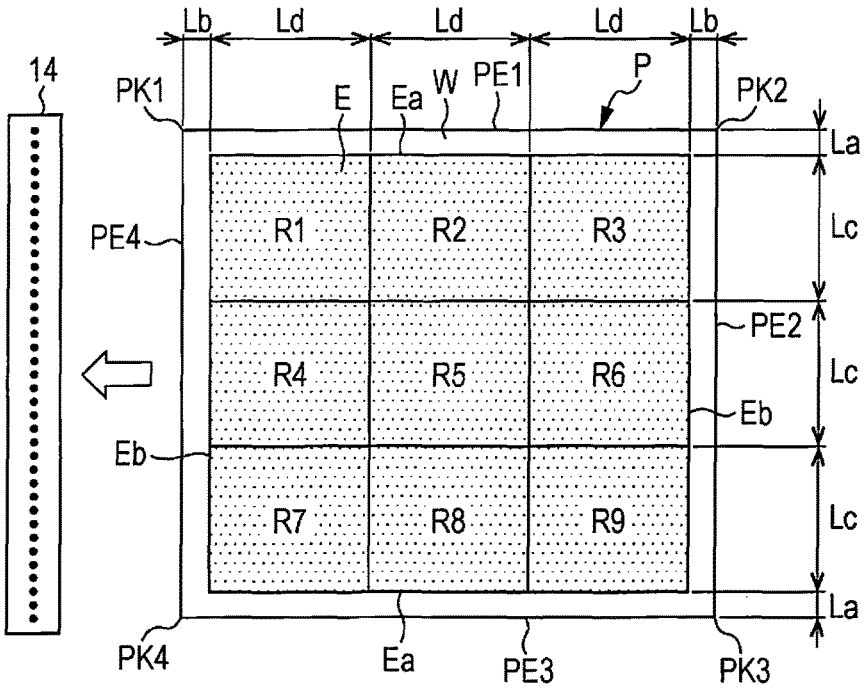
FIG. 4A is a schematic diagram illustrating division regions which are acquired by dividing the printing region of paper.
FIG. 4B is a diagram illustrating a setting table which is used to setting the division regions corresponding to a paper size.

As illustrated in FIG. 4A, the control section divides the printing region E (a part of the shade region in the drawing) of the paper P, which is transported to the recording section 14, into nine division regions R1 to R9. In the embodiment, in the printing region E, a position, which is present inside by a dimension La from a side edge PE1 and a side edge PE3, which are respectively positioned on both sides in the width direction perpendicular to the transport direction (empty white arrow in the drawing), from among four side edges PE1 to PE4 which are included as the outer peripheral edges of the paper P, becomes the regional edges Ea on both sides of the printing region E in the width direction. In addition, positions, which are present inside by a dimension Lb from the side edge PE2 and the side edge PE4 which are respectively positioned on the both sides in the transport direction, are regional edges Eb on the both sides of the printing region E in the transport direction. Further, in the printing region E, the region between the regional edges Ea in the width direction is divided into three parts in a belt shape with a width dimension Lc, respectively, and the region between the regional edges Eb in the transport direction is divided into three parts in a belt shape with a width dimension Ld.

As a result of the division performed in both directions, that is, the width direction and the transport direction, the printing region E is divided into nine rectangular regions that includes a division region R5 which is positioned at the center, and a plurality of division regions R1, R2, R3, R4, R6, R7, R8, and R9 which are positioned at the regional edges of the printing region E, as illustrated in FIG. 4A. Here, the division regions R1, R3, R7, and R9 are regions which are closest to the respective corner sections PK1 to PK4 of the paper P, at which two side edges of the four side edges PE1 to PE4 of the paper P are connected, in the printing region E.

The four division regions R1, R3, R7, and R9 are positioned between the division regions, and form a peripheral region along the edge of the printing region E, together with the four division regions R2, R4, R6, and R8 which do not include the corners of the printing region E. Further, the peripheral region forms a circular belt-shaped region which is included in a fixed distance from the respective side edges PE1 to PE4 of the paper P in the printing region E.

As illustrated in FIG. 4B, in the embodiment, in the setting table, which is stored in the storage section, values of the dimensions La, Lb, Lc, and Ld which indicate the division positions of the division regions R1 to R9 are set according to the size of the paper P which is transported to the recording section 14. Incidentally, in the setting table illustrated in FIG. 4B, the same value "3 mm" is set as the values of the dimension La and the dimension Lb for each paper size. Therefore, in the embodiment, in each of various types of paper P which are transported to the recording section 14, a blank region W, which is a non-printing region to which ink does not adhere and which has the same width, is provided along the periphery of the printing region E, as illustrated in FIG. 4A.

Meanwhile, in the embodiment, "0 mm" may be set as the values of the dimension La and the dimension Lb. "0 mm" is set when, for example, so-called margin-less printing, in which the blank region W, which has the same width and which is the non-printing region, to which the ink does not adhere, in the paper P, is not provided. Further, in this case, the division regions R1, R3, R7, and R9 are regions which respectively include the corner sections PK1, PK2, PK4, and PK3 of the paper P.

Meanwhile, in the embodiment, the division regions are set based on the dimension (paper width) in the width direction, which is perpendicular to the transport direction, of the paper P. That is, when the paper P has a paper width which is shorter than a prescribed length and when a paper size has the paper width corresponding to the prescribed length and the dimension in the transport direction is longer than the dimension in the width direction, the values of the dimension Lc and the dimension Ld are respectively set to values which cause the respective division regions R1 to R9 to be the regions which are acquired by dividing the printing region E into nine parts. In contrast, in a case in which the paper width is equal to or larger than a prescribed length and the paper size is longer than the dimension (paper length) in the transport direction, the values of the dimension Lc and the dimension Ld are set in the setting table such that the respective regions of the division regions R1 to R4 and R6 to R9 are smaller than the size of the division region R5 which is positioned at the center.

Incidentally, in the embodiment, in a case in which the prescribed length is set to 250 mm and the dimension of the paper P in the width direction is smaller than 250 mm and in a case of the paper size in which the dimension of the paper P in the width direction is 250 mm and the dimension in the transport direction is larger than the dimension in the width direction, the value of the dimension Lc is set to a dimension corresponding to one third of a dimension acquired by subtracting the blank region W from the paper width. In addition, the value of the dimension Ld is set to a dimension corresponding to one third of a dimension acquired by subtracting the blank region W from the paper length. In contrast, for a paper size "A4 landscape" and "B5 landscape" in which the dimension (paper width) of the paper P in the width direction is equal to or larger than 250 mm and is larger than the dimension (paper length) in the transport direction, the values of the dimension Lc and the dimension Ld are set to "12 mm".

Returning to FIG. 3, in subsequent step S3, a process of setting continuous regions, which include an end part region that is closest to the corner section of the paper P, to the determination region in the division regions is performed. In the embodiment, the division region R1 which is closest to a corner section PK1, the division region R3 which is closest to the corner section PK2, the division region R9 which is closest to the corner section PK3, and the division region R7 which is closest to the corner section PK4 are set to be the end part regions. Therefore, the control section functions as the determination region setting section 51, and sets the continuous regions, in which the determination regions including the end part regions are continued, to the determination regions in the plurality of (here, nine) division regions (determination region setting step).

Subsequently, in step S4, a process of calculating the average value of printing duties indicative of the liquid volume ratios of ink which is discharged to the determination region is performed based on the discharge data of the ink. Here, the control section functions as the liquid volume ratio calculation section 52, and calculates the average value of the liquid volume ratios of the ink, which is discharged to the plurality of division regions that are set as the determination region from the recording section 14, to the maximum liquid volume of the ink which is capable of being discharged to the plurality of division region from the recording section 14 based on the discharge data of the ink acquired from the printing data (liquid volume ratio calculation step). That is, the average value of the liquid volume ratios which are calculated here is a value which is acquired by taking an average of the liquid volume ratios of the respective division regions. Meanwhile, here, the maximum liquid volume of the ink is the liquid volume of the ink, which is discharged from the recording section 14 when the largest dot is formed with the maximum number of dots on the paper P.

A process performed in steps S3 and S4 will be described with reference to FIGS. 5A and 5B.

Figure 5A:
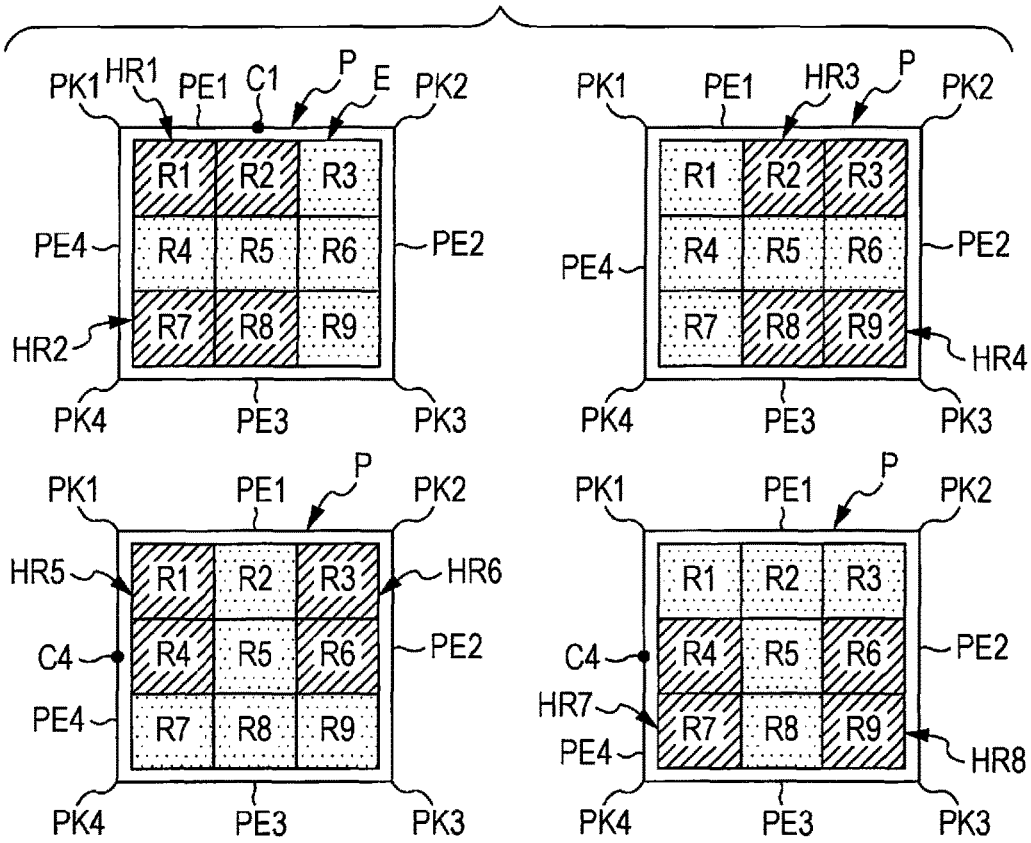
FIG. 5A is a diagram illustrating the division regions which are set as determination regions.

As illustrated in FIG. 5A, in the embodiment, each of the determination regions is set with two (plurality of) division regions, that is, each of the division regions R1, R3, R7, and R9 which are end part regions, and one division region in which the one side of a rectangle comes into contact with each of the division regions R1, R3, R7, and R9 by line contact, thereby being continued in a direction along each of the side edges PE1 to PE4 of the paper P. That is, in the embodiment, it is assumed that the continuous regions, in which the two division regions including the end part region are continued, are the determination regions, and the total eight determination regions HR1 to HR8 are set, as illustrated by hatching regions in FIG. 5A. As an example, the determination region HR1 is established by the division region R1 which is the end part region that is the closest to the corner section PK1, and the division region R2 which is continued with the division region R1 along the one side edge PE1. In addition, the determination region HR5 is established by the division region R1 which is the end part region that is the closest to the corner section PK1, and the division region R4 which is continued with the division region R1 along the one side edge PE4.

In the embodiment, the determination regions HR1, HR2, HR3, and HR4 are regions at fixed distances from the side edge PE1 and the side edge PE3 which are respectively positioned on the both sides of the width direction which is perpendicular to the transport direction, and are regions which have a strong correlation with the generation of the curls. In addition, for example, the respective determination regions HR1, HR2, HR3, and HR4 are present beyond the centers of the side edge PE1 and the side edge PE3 from the sides of the corner sections PK1, PK4, PK2, and PK3 along the side edge PE1 and the side edge PE3 such that the determination region HR1 is present beyond the center C1 of the side edge PE1 from the side of the corner section PK1 along the side edge PE1.

In the same manner, the determination regions HR5, HR6, HR7, and HR8 are regions at the fixed distances from the side edge PE2 and the side edge PE4 which are respectively positioned on the both sides in the transport direction. In addition, for example, the respective determination regions HR5, HR6, HR7, and HR8 are present beyond the centers of the side edge PE4 and the side edge PE2 from the sides of the corner sections PK1, PK2, PK4, and PK3 along the side edge PE4 and the side edge PE2 such that the determination region HR5 is present beyond the center C4 of the side edge PE4 from the side of the corner section PK1 along the side edge PE4.

Meanwhile, in the embodiment, the eight determination regions are not established, and the four determination regions HR1, HR2, HR3, and HR4 which include four corner sections PK1 to PK4 or the four determination regions HR5, HR6, HR7, and HR8 which include four corner sections PK1 to PK4 may be established. For example, when the curl is differently generated depending on the alignment direction of fibers which are included in the material of the paper P, it is preferable to establish determination regions such that the division regions are continued along the side edges which tend to be curled.

Figure 5B:
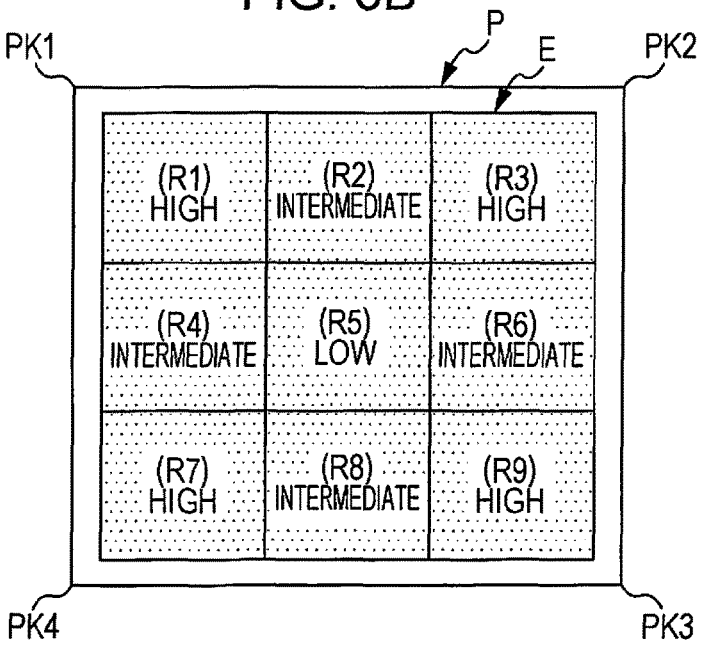
FIG. 5B is a diagram illustrating weights for the liquid volume ratios of the respective division regions in the determination region.

As illustrated in FIG. 5B, in the embodiment, in the division regions R1 to R9, a region which is close to the corner section of the paper P has a strong correlation with the generation of the curls. Therefore, when a process of calculating the average value of the printing duties is performed in step S4, weighting is performed on the liquid volume of the ink, which is actually discharged, according to the strength of the correlation with the generation of the curls. That is, in the division regions R1, R3, R7, and R9, which are close to the corner sections PK1 to PK4 of the paper P in which the correlation with the generation of the curls is strong, the weighting is set to "high". Further, in the division region R5, which is the farthest from the corner sections PK1 to PK4, the weighting is set to "low". Further, in the other division regions R2, R4, R6, and R8, the weighting is set to "intermediate".

For example, when the coefficient of the weight of "low" is set to "1", the average value of the printing duties is calculated with regard to the determination region HR1 in such a way that the liquid volume of the ink which is discharged to the division region R1 is multiplied by "1.3" as the coefficient of the weight "high" and that the liquid volume of the ink which is discharged to the division region R2 is multiplied by "1.2" as the coefficient of the weight "intermediate". In step S4, the liquid volume of the ink which is discharged is multiplied by each of the coefficients of the weighting in the division regions. Therefore, in each of the eight determination regions HR1 to HR8, the average value of the printing duties is calculated.

Returning to FIG. 3, a process of detecting the temperature and the humidity of the paper which is acquired before printing is performed in subsequent step S5. Here, when the control section acquires the temperature and the humidity which are detected by the temperature and humidity detection section 70 included in the printer 11, the temperature and the humidity in the vicinity of the paper P which is transported by the pair of paper feeding rollers 17 are detected as the temperature and the humidity of the paper P (temperature and humidity detection step).

Subsequently, a process of setting the thresholds of the printing duties according to the discharge data of the ink, the size of the paper, the orientation for the transport direction, the temperature, and the humidity is performed in step S6. In the embodiment, the thresholds are set according to the sizes and shapes of the determination regions. For example, the thresholds are set in such a way that the control section input the numerical values (thresholds) acquired in advance through examination or the like to a user using an input section which is not shown in the drawing, and stores the input numerical values in the storage section as the threshold table. Otherwise, the thresholds are set by storing the threshold table, which is input together with a program for controlling the printing operation, in the storage section.

FIGS. 6A and 6B illustrates an example of the threshold table which expresses thresholds which are set for the determination regions HR1 to HR8. FIG. 6A is a threshold table TA which expresses thresholds which are set for the respective division regions for a paper size in which a paper width is shorter than a prescribed length (250 mm). FIG. 6B is a threshold table TB which expresses thresholds which are set for the respective division regions for a paper size in which a paper width is equal to or larger than the prescribed length (250 mm). That is, the threshold table TA is set up in a case of a paper in which the paper width is shorter than the prescribed length 250 mm, and the threshold table TB is set up in a case of a paper in which the paper width is equal to or larger than the prescribed length 250 mm.

In the embodiment, in the case of the paper in which the paper width is shorter than the prescribed length 250 mm (threshold table TA), the thresholds of the printing duties, which have values larger than the case of the paper in which the paper width is equal to or larger than the prescribed length 250 mm (threshold table TB), are set to the respective division regions R1 to R9 in the printing region E. That is, in the case of the paper in which the paper width is equal to or larger than the prescribed length 250 mm, the curl is easily generated, and thus the thresholds of the printing duties are small compared to the case of the paper in which the paper width is shorter than 250 mm.

Meanwhile, the curl which is generated in the paper P depends on the temperature and the humidity. Therefore, in the embodiment, six states are detected by the temperature and humidity detection section 70, that is, a temperature state is divided into a low temperature, a room temperature, and a high temperature, and, in each of the temperatures, a humidity state is divided into a low humidity and a high humidity. Further, in the detected six states, respective thresholds are set.

In addition, the curl which is generated in the paper P depends on the resolution of a printing image, that is, the maximum number of dots which are formed through adhesion of the ink, and thus the thresholds are set for respective cases in which the resolution is high and the resolution is low for the respective paper sizes. For example, the respective thresholds are set in such a way that a maximum number of dots 600×1200 corresponds to a low resolution and a maximum number of dots 600×2400 corresponds to a high resolution.

In addition, in the embodiment, in the respective division regions R1 to R9, the thresholds are small in a case of a low temperature and a low humidity compared to other cases, and the thresholds of the paper P having some kind of paper sizes are large in a case of a high temperature and a high humidity compared to other cases. The reason for this is that it is difficult that the curls are generated in the case of the high humidity compared to the low humidity. Further, the threshold in a case in which the resolution of the printing image is low is set to be larger than the threshold in a case in which the resolution is high. The reason for this is that the maximum number of dots which can be formed through the adhesion (impact) of the ink is small in a case in which the resolution is low, and thus it is difficult that the curls are generated.

Returning to FIG. 3, subsequently, a process of determining whether or not the printing duty is equal to or larger than the threshold is performed in step S7. The process is performed by the control section. When the largest average value of the average values of the printing duties of the respective determination regions HR1 to HR8, which are calculated in step S4, is compared with the threshold of the printing duty which is set using the threshold table, it is determined whether or not the curls are generated (determination step). As a result of the determination process in step S7, when the average value of the calculated printing duties of the determination regions is not equal to or larger than the set threshold (step S7:NO), it is determined that the curl is not generated, and the process ends here without performing any process.

In contrast, as the result of the determination process in step S7, when the largest average value of the average values of the printing duties of the respective determination regions HR1 to HR8 is equal to or larger than the set threshold of the printing duties (step S8: YES), it is determined that the curls are generated, and a process of adjusting the distance from the support surface 13*a* of the recording section 14 is performed in subsequent step S8.

A process in step S8 will be described with reference to FIGS. 7A and 7B.

As illustrated in a thick dashed line in FIG. 7A, the paper P, which is supported by the support surface 13*a* of the support pedestal 13, is transported over the support surface 13*a* in such a way that the moisture content of the printing surface side is higher than the moisture content of a non-printing surface side due to the ink solvent as the moisture included in the adhered ink, thereby being a state in which the curl is rising upward. At this time, a distance GP of the recording section 14 from the support surface 13*a*, that is, the gap between the lower part of the recording section 14 and the support surface 13*a* is adjusted so as to prevent the recording section 14 and the paper P from touching and rubbing. Here, the control section functions as the recording position adjustment section 54, and the eccentric cam 14*b* (refer to FIG. 2A) is rotated by a prescribed amount by driving a driving source and the holding body 14*a*, which holds the liquid discharge head, is raised. Therefore, the distance GP of the recording section 14 (liquid discharge head) from the support surface 13*a* is adjusted to a set value.

As illustrated in FIG. 7B, in the embodiment, with regard to the distance GP, values according to the highs and lows of the resolution of a printing image and the thickness of the paper P is previously set, and is stored in the storage section in the form of a distance table. Further, when the calculated printing duty is equal to or larger than the set threshold, the recording position adjustment section 54 adjusts the distance of the recording section 14 from the support surface 13*a* to a distance which is longer than a case of the liquid volume ratio, which is smaller than the threshold, by a prescribed dimension. By the way, in the embodiment, when the calculated printing duty is equal to or larger than the set threshold, the distance GP is adjusted to a distance which is longer by 0.7 mm compared to a case of a printing duty which is smaller than the threshold.

By the way, in the embodiment, when the resolution of the printing image is low and the paper P is thin and when the calculated printing duty is smaller than the set threshold, the distance GP is adjusted to the smallest 1.3 mm. When the calculated printing duty is smaller than the set threshold in the other cases, the distance GP is adjusted to 1.5 mm. In addition, when the resolution of the printing image is low and the paper P is thin and when the calculated printing duty is equal to and larger than the set threshold, the distance GP is adjusted to 2 mm which is larger than 1.3 mm by 0.7 mm. When the calculated printing duty is equal to or larger than the set threshold in the other cases, the distance GP is adjusted to 2.2 mm which is larger than 1.5 mm by 0.7 mm.

Meanwhile, in the embodiment, the thickness of the paper P is set when, for example, a user inputs the type of the paper P to be accommodated in the paper cassette 12*c* to the storage section. Otherwise, the thickness of the paper P is input after being included in the printing data, and is set to the storage section. Further, the control section reads the thickness of the paper P, which is set to the storage section, and performs a process in step S8.

Returning to FIG. 3, a process of adjusting the dryness degree of the paper P which is printed by the recording section 14 is performed in subsequent step S9. Here, the control section functions as dryness degree adjustment section 55, controls the rotation speeds of the respective rollers, such as the pair of transport rollers 19 in the transport section 29, and adjusts the transport speed of the paper P. Therefore, time in which the paper P is transported from the recording section 14 to the medium outlet 26 is adjusted. When the transport time is adjusted, time in which the ink, which adheres to the paper P, is dried is adjusted. In the paper P, the amount of evaporation of the ink solvent from the adhered ink is adjusted when the drying time is adjusted. As a result, the dryness degree of the paper P is adjusted.

Figures 8, 9:
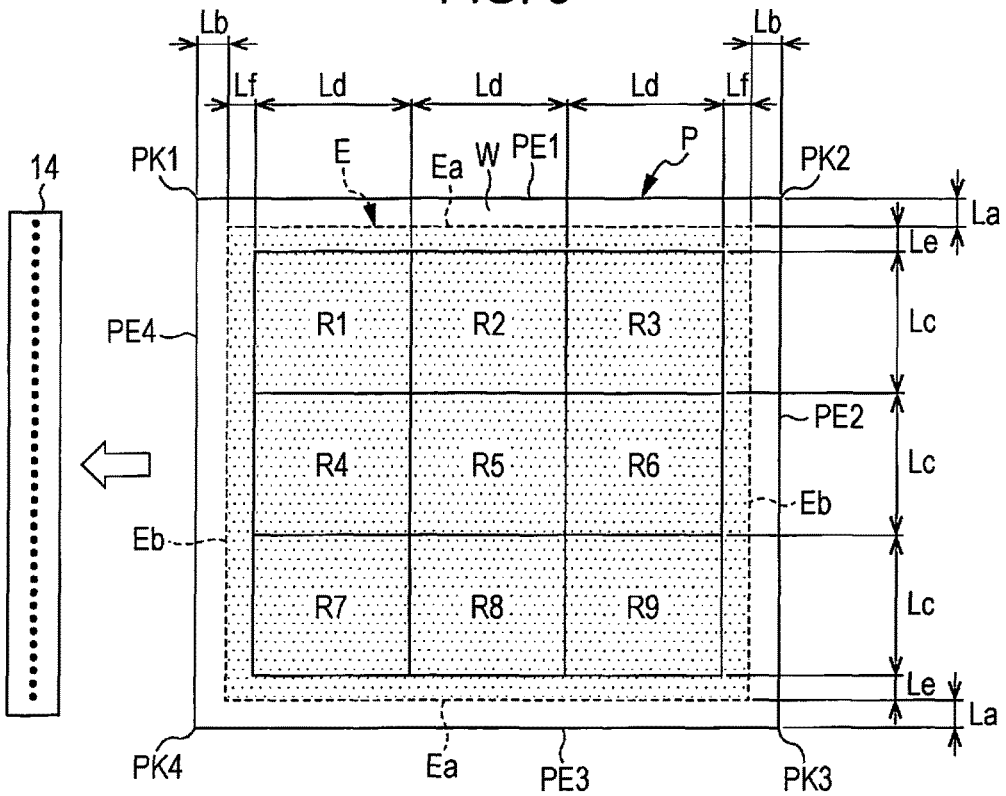
FIG. 8 is a diagram illustrating a time table in which drying time necessary for printed paper is set.
FIG. 9 is a schematic diagram illustrating a state in which the determination regions are set to an internal region, which is smaller than a printing region, in the printing region.

FIG. 8 illustrates an example of the drying time to be adjusted. In the embodiment, the drying time is input accompanying with a program, and is stored in the storage section as a time table. Further, the control section reads the corresponding drying time from the time table which is set in the storage section, and performs a process in step S9.

As illustrated in FIG. 8, the drying time of the paper P is set without depending on the resolution of the printing image or the thickness of the paper P. In addition, in the same manner, a value which depends on the temperature and the humidity of the medium transport path 20, through which the paper P is transported, is set without depending on each paper size. That is, in the embodiment, in total six states in which the temperature state is divided into the low temperature, the room temperature, and the high temperature and the humidity state is divided into the low humidity and the high humidity in each of the temperatures, the drying times are respectively set. By the way, in the embodiment, the longest drying time 20 seconds is set when the temperature is the low temperature and the humidity is the low humidity, and the shortest drying time 1 second is set when the temperature is the high temperature and the humidity is the high humidity. In addition, it is difficult that the curls are generated in a case of the high humidity compared to the low humidity, and thus the short drying time is set.

Meanwhile, in the paper P, the curls are generated due to bimetal effects between a paper layer, to which the ink adheres and permeates, and a paper layer to which the ink does not permeate. Therefore, the ink may be evaporated and dried in order to correct the curl, and thus it is possible to rapidly dry the ink by sending the paper P at a high speed by raising the transport speed such that the ink is easily dried, regardless of the long and short drying time. However, when the paper P is rapidly transported, time in which the paper P moves from the recording section 14 to the medium outlet 26 becomes short, and thus the dryness degree of the paper P is low when being mounted on the mounting pedestal 60. By the way, it is found that the amount of evaporation of the ink on the paper P is larger in a case in which the paper P is transported at a speed of one half of the highest speed than a case in which the paper P is transported at the highest speed. Further, the amount of evaporation of the ink is further larger in a case in which the paper P is transported at a speed of one fourth of the highest speed. Therefore, in the embodiment, the drying time is caused to be long by causing the transport speed to be slow, and thus the medium transport path 20 is adjusted such that the transported paper P is dried at a high dryness degree.

Meanwhile, in the embodiment, when the transport section 29 successively transports a plurality of pieces of sheet-shaped paper P, the determination section 53 determines whether or not the curls are generated for each of the plurality of pieces of paper P which are transported through the medium transport path 20. Further, although the detailed adjustment method thereof is not described here, the dryness degree adjustment section 55 adjusts the transport speed of the paper P, which is transported by the transport section 29, according to each of the plurality of pieces of paper P by adjusting the rotation speed of the pair of transport rollers 19 in, for example, the medium ejection path 25.

In addition, when the plurality of pieces of paper P are successively transported, the transport section 29 adjusts the transport speed of the paper P such that the paper P which is previously transported along the medium transport path 20 does not come into contact with the paper P which is transported later on the medium transport path 20. For example, when the transport speed of the paper P, which is printed and previously transported on the medium ejection path 25, is adjusted to be slow such that a dryness degree becomes high, contact between the pieces of paper P is prevented in such a way that the transport speed of the paper P, which is subsequently printed and transported, is also adjust to be slow or such that time until transport starts become late.

According to the embodiment, it is possible to acquire the following advantages.

(1) since the liquid volume ratios (printing duties) of the continuous region, which includes an end part region close to the corner section of the paper P in the printing region E, have a strong correlation with the generation of the curls, it is possible to accurately determine the generation of the curls based on the average value of the printing duties while it is assume that the continuous region as the determination region. As a result, the friction between the paper P, which is transported according to the accurately determined generation of the curls, and the recording section 14 is appropriately avoided, and thus it is possible to record a high-quality image on the paper P.

(2) Since a part of the region, which has the largest average value of the printing duties, of the determination regions, which include the end part region, in the printing region E has the strong correlation with the generation of the curls, it is possible to accurately determine the generation of the curls by comparing the largest average value of the printing duties of the determination regions with the threshold.

(3) Since the printing duties of the determination regions in the fixed distance from the side edges of the paper P in the printing region E have the strong correlation with the generation of the curls, it is possible to accurately determine the generation of the curls based on the average value of the printing duties of the determination regions in the fixed distance from the side edges of the paper P.

(4) When the determination regions are set up to the region which reaches over the center of the side edges of the paper P, the printing duties of the determination regions have the strong correlation with the generation of the curls, and thus it is possible to accurately determine the generation of the curls based on the average value of the printing duties of the determination regions.

(5) Since the temperature and the humidity have the strong correlation with the generation of the curls in the printing region E, it is possible to accurately determine the generation of the curls according to the temperature and the humidity of the detected paper P.

(6) Since the printing duties of the continuous regions, which include the end part region, in the printing region E have the strong correlation with the generation of the curls, it is possible to accurately determine the generation of the curls based on the average value of the printing duties while the continuous regions are set to the determination regions. As a result, when the paper P is appropriately dried according to the curl which is actually generated in the paper P, it is possible to smoothly transport the paper P along the medium transport path 20.

(7) It is possible to dry the paper P at a dryness degree according to the actually generated amount of curls of the paper P without additionally providing heating device such as a heater.

(8) When the transport speed on the medium transport path 20 is adjusted according to the curl which is respectively generated in the plurality of pieces of paper P, it is possible to dry the paper P at the dryness degree according to the generated curl of the paper P.

(9) It is possible to prevent deterioration in the quality of the image or the like, which is recorded on the paper P, accompanying with the contact between the pieces of paper P.

Meanwhile, the embodiment may be modified by additional embodiment as below.

In the embodiment, one of the process of adjusting the distance of the recording section 14 from the support surface 13*a* (step S8) and the process of adjusting the dryness degree of the paper P which is printed by the recording section 14 (step S9) may be performed. For example, when the distance of the recording section 14 from the support surface 13*a* is set to be large and there is no problem in that curled paper P comes into contact, only the process of adjusting the dryness degree may be performed. Otherwise, when there is a problem in that the curled paper P is in a jam state on the transport path, only the process of adjusting the distance of the recording section 14 from the support surface 13*a* may be performed.

In the embodiment, the division regions R1 to R9 may not be necessarily regions which are acquired by dividing the whole part of the region up to the regional edges Ea and Eb of the printing region E. For example, the division regions R1 to R9, to which the determination regions are set, may be regions which are acquired by dividing a region inside the regional edges Ea and Eb of the printing region E. The modification example will be described with reference to the drawings.

As illustrated in FIG. 9, in the modification example, in the printing region E of the paper P, an internal region, which is smaller than the printing region E and which is determined by positions that are respectively present inside by a dimension Le from the regional edges Ea on both sides in the width direction is perpendicular to the transport direction to the recording section 14 and positions that are respectively present inside by a dimension Lf from the regional edges Eb on both ends in the transport direction, is acquired through division. Therefore, the division regions R1 to R9 are internal regions of the printing region E.

As in the modification example, in the printing region E, when the division regions R1 to R9 are formed by dividing the internal region of the printing region E, the division regions as the determination regions do not include the regional edges Ea and Eb of the printing region. For example, ink which adheres to the vicinity of the regional edges Ea and Eb of the printing region disperse to a blank region W to which ink does not adhere, and thus there is a case in which a dispersion state is different from an ink dispersion state inside the printing region E which is an ink adhesion region. In such a case, the correlation of the average value of the printing duties with the generation of the curls may change. Here, when a region, which does not include the regional edges Ea and Eb of the printing region, is set to the division regions (determination regions), it is possible to expect a high possibility that the average value of the printing duties in the determination regions is correlated with the amount of curls which is actually generated in the paper P.

In the embodiment, the number of divisions performed on the printing region E may be large. In addition, a plurality of continuous regions, which includes the end part region that is the closest to the corner section of the paper P and which are continued along the at least one side edge of the paper P for the end part region, may be set as the determination regions. As one of the modification example, a case in which the determination regions are set as the continuous regions, which are continued along two side edges, will be described with reference to the drawing.

Figure 10A:
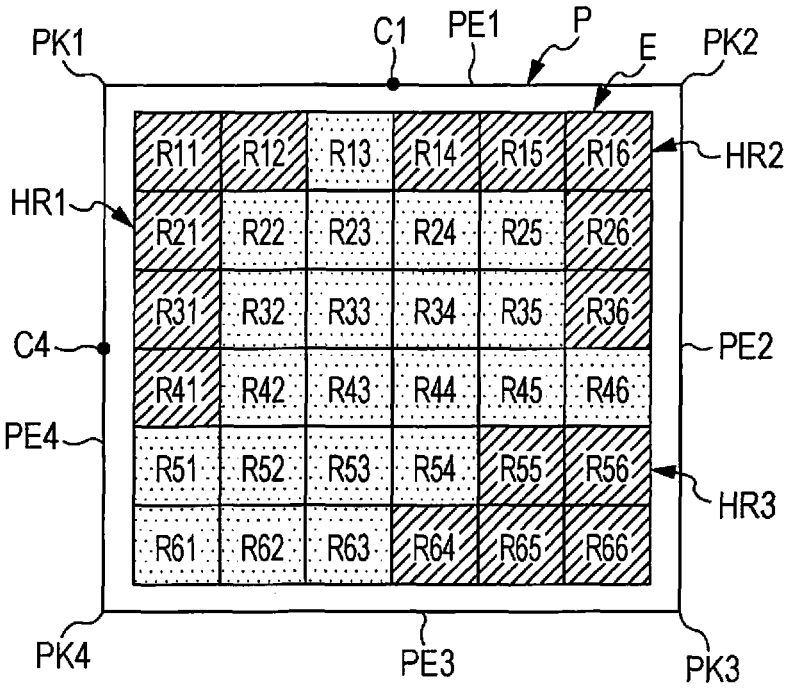
FIG. 10A is a schematic diagram illustrating an example of the determination regions which are set in the division regions which have a different number of divisions.

As illustrated in FIG. 10A, in the modification example, the control section equally performs a six number of divisions on both directions, that is, the transport direction of the paper P and the width direction which is perpendicular to the transport direction in the printing region E of the paper P, thereby setting total 36 division regions from a division region R11 to a division region R66. Further, as illustrated using hatching regions in FIG. 10A, an end part region, which is the closest to the corner section of the paper P, and division regions, which are continued along the side edges on both sides that interpose the corner section for the end part region, are set as the determination regions.

For example, as illustrated in a determination region HR1, the determination region according to the modification example may be set with total five division regions such as the division region R11 which is an end part region that is the closest to the corner section PK1, one division region R12 which is continued along the side edge PE1, and three division regions R21, R31, and R41 which are continued along the side edge PE4. Otherwise, as illustrated in a determination region HR2, the determination region may be set with total five division regions, that is, a division region R16 which is an end part region that is the closest to the corner section PK2, two division regions R15 and R14 which are continued along the side edge PE1, and two division regions R26 and R36 which are continued along the side edge PE2. Otherwise, as illustrated in a determination region HR3, the determination region may be set with total five division regions, that is, a division region R66 which is an end part region that is the closest to the corner section PK3, one division region R56 which is continued along the side edge PE3, and two division regions R65 and R64 which are continued along the side edge PE3, and a division region R55 which is continued to both the division region R56 and the division region R65. Meanwhile, in FIG. 10A, a determination region, which is set for the corner section PK4, is not shown.

Figure 10B:
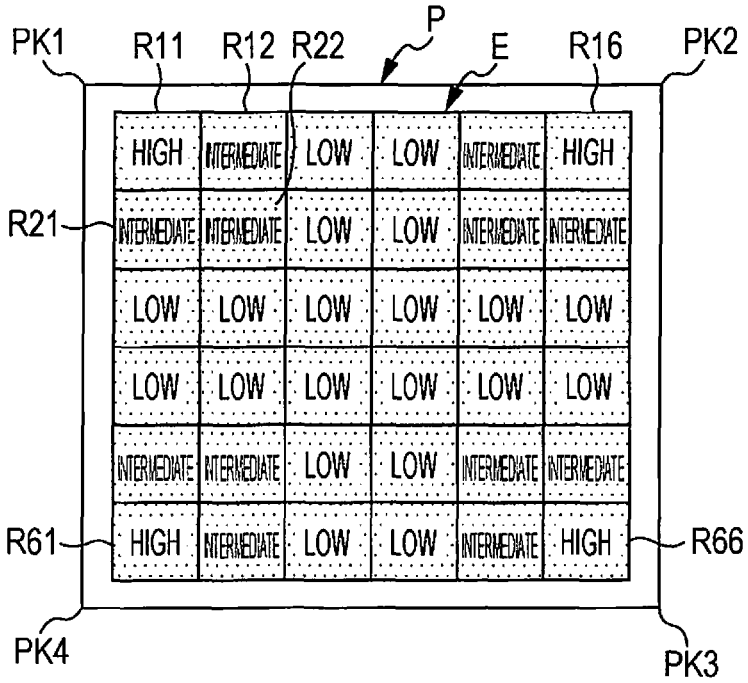
FIG. 10B is a diagram illustrating weights for the liquid volume ratios of the respective division regions.

As illustrated in FIG. 10B, in the modification example, the division regions R11 to R66 are acquired by equally dividing the printing region E, thereby having the same regional area. Therefore, when the process of calculating the average value of the printing duties in step S4 shown in FIG. 3 is performed, the liquid volume of the ink, which is actually discharged, is weighted. That is, in the modification example, the weights of the division regions R11, R16, R66, and R61, which are end part regions that are the closest to the corner sections PK1 to PK4, which have the strong correlation with the generation of the curls, of the paper P are set to "high", and the weights of the respective division regions which are positioned next to the end part regions are set to "intermediate". Further, the weights of the other division regions are set to "low".

In the embodiment, division regions may be not necessarily regions which are equally divided in the printing region E. For example, division may be performed such that the ratio of the regional area is in inverse proportion to the weight according to the strength of the correlation between the liquid volume of the ink, which is actually discharged, and the generation of the curls of the paper P. The modification example will be described with reference to the drawings. Meanwhile, here, in order to provide easy description, the printing region E is divided into 36 parts similarly to the division illustrated in FIG. 10A.

Figure 11:
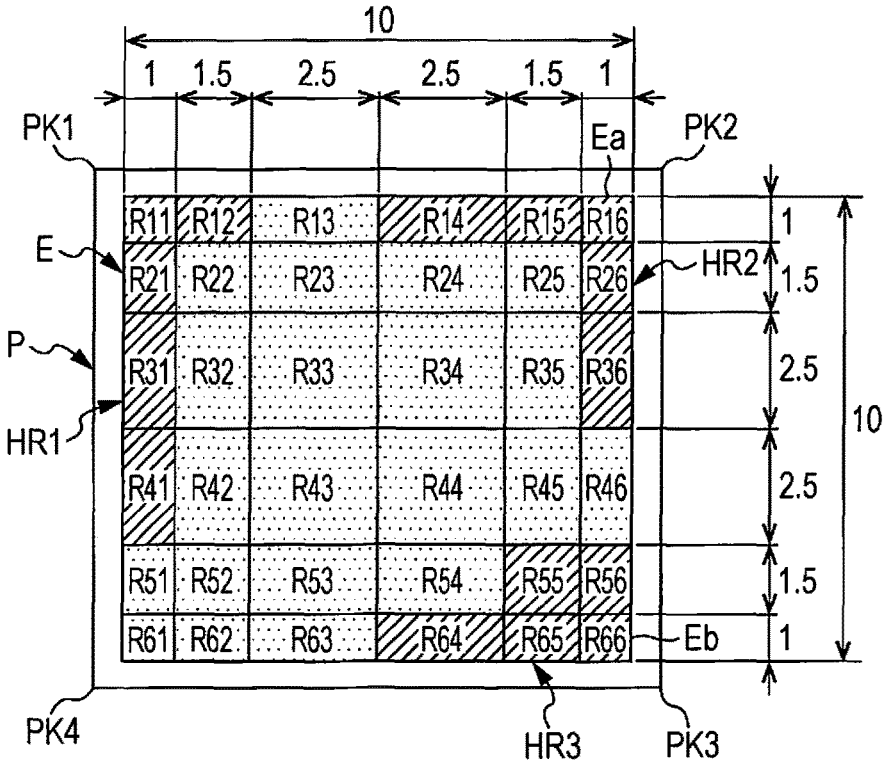
FIG. 11 is a schematic diagram illustrating paper which is divided into division regions having different regional areas according to a modification example.

As illustrated in FIG. 11, when the control section sets the respective lengths of the printing region E to "10" on the both sides, that is, in the width direction, which is perpendicular to the transport direction, and in the transport direction in the printing region E of the paper P, six divisions are performed on a belt shape by a lengths having a ratio of "1:1.5:2.5:2.5:1.5:1", thereby setting total 36 division ranges which include division regions R11 to R66. Further, as illustrated in hatching regions in FIG. 11, the determination regions HR1, HR2, and HR3 are set as continuous region similarly to FIG. 10A. Therefore, the sizes (regional areas) of the division regions become weights, it is possible to calculate the average value of the printing duties in the respective determination regions without multiplying the division regions by the coefficients of the weights in the process of step S4 of FIG. 3, and thus it is easy to perform the process of calculating the average value of the printing duties.

Originally, it is preferable that the division ratios of the respective lengths on both the sides, that is, the width direction, which is perpendicular to the transport direction, and the transport direction in the printing region E are set according to the number of divisions performed on the printing region E and the strength of the correlation between the liquid volume of the ink, which is actually discharged, and the generation of the curls of the paper P.

In the embodiment, the determination region may not be necessarily set to the continuous region which is continued from the end part region along one side edge of the paper P. The modification example will be described with reference to the drawings. Meanwhile, in the modification example, a case in which the printing region E is divided into 36 parts will be described similarly to FIG. 10A.

Figure 12:
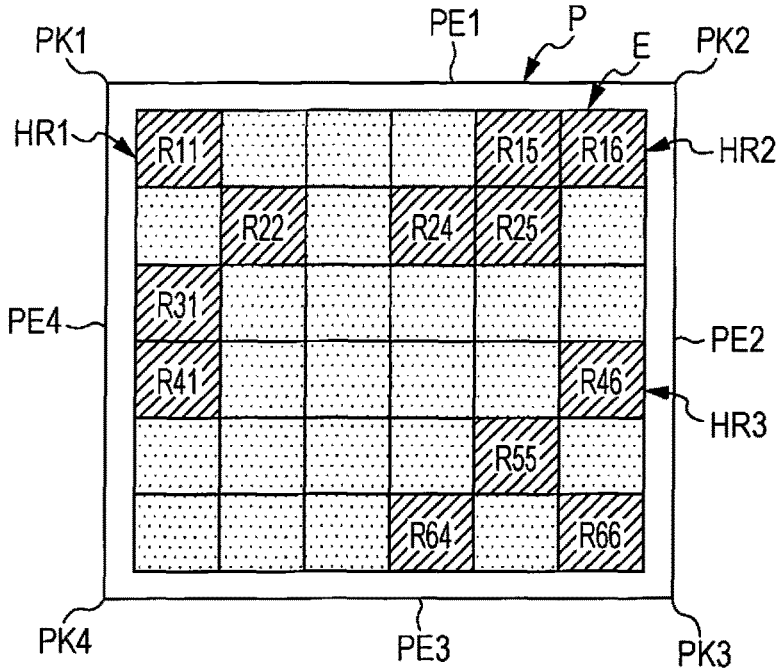
FIG. 12 is a schematic diagram illustrating the determination regions which are continuous regions in which a plurality of regions are continued.

As illustrated in FIG. 12, in the modification example, other than a state in which one rectangular sides of the determination regions come into contact with each other by lines, a state in which regions come into contact with each other by one point is assumed as a state in which regions are connected, as illustrated in the determination region HR1. That is, the determination region may be set with total four division regions, that is, a division region R11 which is the end part region, a division region R22 which is continued to the division region R11 in a point contact state, a division region R31 which is continued to the division region R22 in the point contact state, and a division region R41 which comes into contact with the division region R31 along the side edge PE4 in the point contact state.

Otherwise, as illustrated in the determination region HR3, the determination region may be set with total four division regions, that is, a division region R66 which is the end part region, a division region R55 which is continued to the division region R66 in the point contact state, and two division regions R46 and R64 which are continued to the division region R55 in the point contact state. That is, the determination region may be in a state in which regions, which are printing duty calculation targets, are arranged in a mosaic state in the division regions.

In addition, as illustrated in the determination region HR2, the determination regions may be set with total four division regions, that is, a division region R16 which is the end part region, a division region R15 which is continued along one side edge PE1, a division region R25 which is continued to the division region R15 along another side edge PE2, and a division region R24 which is continued to the division region R25 along the side edge PE1. That is, the determination region may be in a state in which regions, which are the printing duty calculation targets, are curved in the division regions.

In the embodiment, the determination region may be not necessarily a region which is present inside a fixed distance from the side edge in the paper P. For example, as in the determination regions HR1, HR2, and HR3 corresponding to the case of the modification example illustrated in FIG. 12, each of the determination regions may be a region, in which a distance changes, other than the region which is present inside the fixed distance from the side edges PE1 to PE4 in the paper P.

As above, even when the determination region is a region in which the distance from the side edges PE1 to PE4 in the paper P changes, the determination region is a continuous region which is continued from the end part region. Therefore, the correlation with the generation of the curls which is generated in the paper P is maintained. In other words, it is preferable to set the determination region according to a region, in which the correlation with the generation of the curls is strong, without setting the distance from the side edge of the paper P to be fixed.

In the embodiment, the division region may be not necessarily divided as a rectangular shape. The modification example will be described with reference to the drawings.

Figure 13:
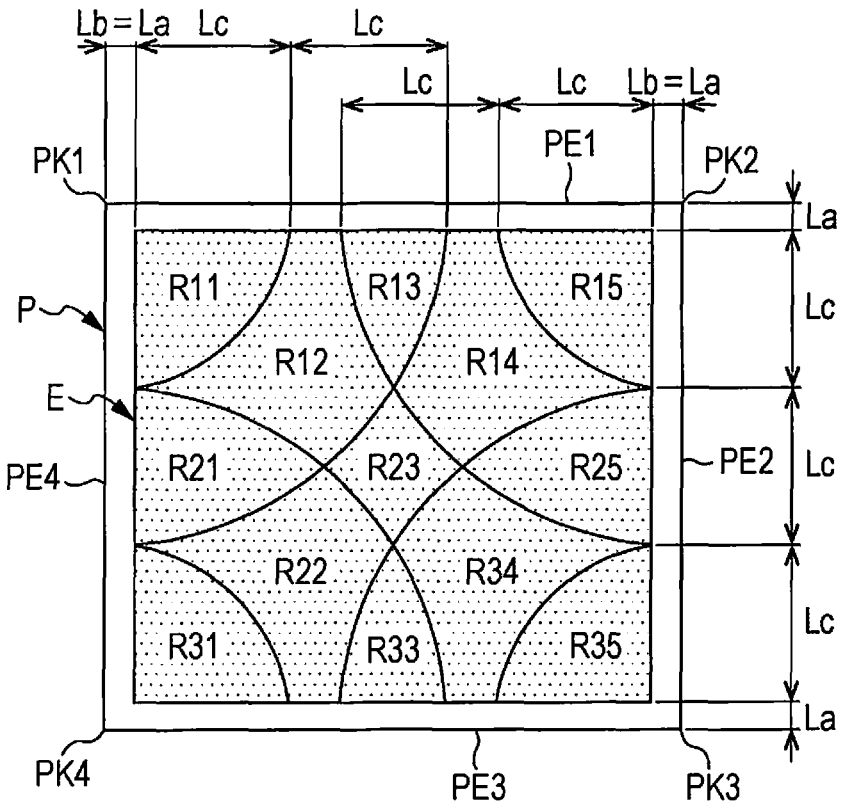
FIG. 13 is a schematic diagram illustrating a method of dividing into the division regions according to the modified example.

As illustrated in FIG. 13, in the modification example, for example, the control section may divide the printing region E of the paper P (a part of shade region in the drawing) to be transported to the recording section 14 into two concentric circles, that is a circle, which has a radius of dimension La+dimension Lc and in which each of the corner sections PK1 to PK4 of the paper P is the center, and a circle which has a radius of dimension La+dimension Lc+dimension Lc. As a result, when the length of the side edge PE1 is larger than the length of the side edge PE2, the printing region is divided into 35 division regions R11 to R35, as illustrated in FIG. 13.

A division region R11, which is the end part region that is the closest to, for example, the corner section PK1 in the 35 division regions, has a region which is present inside a fixed distance from the corner section PK1 and has a "high" correlation with the corner section PK1 for the generation of the curls. In addition, the division regions R21, R12, and R13 are present inside the fixed distances from the corner section PK1, becomes a region which is further separated from the corner section PK1 than the division region R11, and has an "intermediate" correlation with the corner section PK1 for the generation of the curls.

Although the other corner sections PK2, PK3, and PK4 will not be described here, division regions, which have the correlation with the generation of the curls, are set inside fixed distances from the corner sections PK2, PK3, and PK4, similarly to the corner section PK1. Therefore, in the modification example, for example, the division region R12 has a correlation "intermediate" with the corner section PK1 and has a correlation "intermediate" with the corner section PK1. In addition, division region R21 has a correlation "intermediate" with both the corner section PK1 and the corner section PK4. In addition, the division region R23 has a correlation "low" with each of the corner sections for the generation of the curls.

Meanwhile, in the modification example, division may be performed such that the division regions are separated from the corners of the printing region E by a fixed distance instead of the corner sections of the paper P. That is, the division lines of the concentric circles may be arcs which have the corners of the printing region E as centers. In brief, the division regions, which are included in the determination region, may be regions which are acquired through division such that the printing duty of the determination region has the correlation with the amount of curls which is actually generated in the paper P.

In the embodiment, the determination regions may be not necessarily set to all of the corner section of the paper P. For example, in a case of header printing or the like in which ink adheres approximately uniformly to the paper P, the average values of the printing duties in the determination regions of the respective corner sections are the same. In such a case, the determination region may be set in at least one corner section.

Otherwise, when determination regions are set in a plurality of corner section, whether or not the largest average value of the average values of the printing duties in the plurality of determination regions is larger than the threshold may not be necessarily determined. For example, with regard to the average value of the printing duties of the plurality of determination regions, whether or not a value acquired by further averaging the plurality of average values is larger than the threshold may be determined.

In the embodiment, the determination region setting section 51 may not necessarily set the determination regions such that the determination regions are present over the center of one side edge from the side of the corner section along the one side edge. For example, the determination region HR1 may be set to a region, which does not reach over the center C1 of the side edge PE1 (refer to FIG. 5A) from the side of the corner section PK1, if the region is included in a range in which it is possible to accurately determine the generation of the curls.

In the embodiment, the temperature and humidity detection section 70, which detects the temperature and the humidity of the paper P before recording is performed, may be not provided. For example, when the change in the temperature and the humidity of the paper P is prevented as in a case in which the printer 11 is installed in an atmosphere at constant temperature and humidity, it is not necessary to necessarily detect the temperature and the humidity.

In the embodiment, a timing in which the curl is determined may include a case of front surface printing, a case of rear surface printing, or the other cases.

In the embodiment, for example, when the printing data includes data of a plurality of pages (plural sheets), all of the pages corresponding to the printing data may be printed by evacuating (adjusting) the recording section 14 to a distance which is the most separated from the support surface 13*a* in the plurality of pages. In this manner, the adjustment movement is not performed on the recording section 14 (line head) when the printing is being performed, and the transport of the paper P for the adjustment movement is not delayed, thereby preventing the deterioration of the throughput of printing.

Meanwhile, when the recording section 14 is adjusted from the support surface 13*a*, a slider cam, which performs adjustment by causing a carriage to slide, and a cam which performs adjustment by rotating a shaft that supports the recording section 14.

Otherwise, after printing of one page, which should be most separated, in the printing data corresponding to the plurality of pages, adjustment may be performed such that the position of the recording section 14 is gradually close to the support surface 13*a* according to the printing data of the page corresponding to the printing target from the subsequent page of the one page. That is, a configuration is made such that, when the printing data corresponding to one page, which should be the most separated in remaining pages, is finished, the position of the recording section 14 is caused to be close to the support surface 13*a* again. In this manner, it is possible to prevent the movement distance of the recording section 14 from being long when adjustment is performed, and thus it is possible to suppress the deterioration of the throughput.

In the embodiment, when the transport section 29 successively transports a plurality of (pieces of) paper P, the transport section 29 may not necessarily adjust the transport speed of the paper P such that a previously transported paper P does not come into contact with a subsequently transported paper P on the medium transport path 20. For example, even when printing is performed in the central regions of the pieces of paper P and the pieces of paper P overlap with each other, the contact between the pieces of paper P on the medium transport path 20 is allowable if the printing parts do not exist in the overlapping parts.

In the embodiment, the dryness degree adjustment section 55 may not necessarily adjust the dryness degree of the paper P by adjusting the transport speed of the paper P which is transported by the transport section 29. For example, the dryness degree of the paper P may be adjusted by transporting the printed paper P to the branched transport path 24 once, causing the printed paper P to wait in the branched transport path 24 during a prescribed time, causing the printed paper P to return to the third medium supply path 23 and to pass through the recording section 14 again, and transporting the printed page p to the medium ejection path 25.

Otherwise, although description is not performed here with reference to the drawings, for example, the dryness degree of the paper P may be adjusted by adjusting a thermal dose in such a way that a heating device, such as a heater, is provided in the middle of the medium transport path 20. Otherwise, the dryness degree of the paper P may be adjusted by adjusting the amount of applied air (air flow) or the temperature of the air in such a way that a ventilator which is capable of apply the air to the paper P which is transported through the medium transport path 20. Otherwise, the dryness degree of the paper P may be adjusted by adjusting the length of the medium transport path 20 through which the paper P is transported.

In the embodiment, the recording section 14 is not limited to the configuration of a so-called line head which includes a liquid discharge head that is capable of discharging ink over approximately the entirety of the area of the paper P in the width direction. For example, the recording section 14 may have a configuration of a so-called serial head which includes a liquid discharge head for discharging ink to a carriage that reciprocates in the direction which is perpendicular to the transport direction of the paper P.

In the embodiment, the transport section 29 is not limited to perform transport using the rollers, and may perform transport using a belt. In such a case, the support surface 13*a* is a surface in which the belt comes into contact with the paper.

In the embodiment, a supply source, which supplies ink that is recording liquid discharged from the recording section 14, may be, for example, an ink container which is provided inside the housing 12 of the printer 11. Otherwise, the supply source may be a so-called external type ink container which is provided on the outside of the housing 12. In particular, the capacity of ink is large in a case of the external type ink container, and thus it is possible to discharge a larger amount of ink from the recording section 14.

Meanwhile, when ink is supplied to the recording section 14 from the ink container which is provided on the outside of the housing 12, it is necessary to draw an ink supply tube for supplying ink inside from the outside of the housing 12. Accordingly, in this case, it is preferable to provide a hole or a notch, which is capable of inserting the ink supply tube, in the housing 12. Otherwise, a gap may be provided in the housing 12 and the ink supply tube may be drawn from the outside to the inside of the housing 12 through the gap. In this manner, it is possible to easily supply ink to the recording section 14 using the ink flow path of the ink supply tube.

In the embodiment, the printer 11 as the recording device may be a fluid discharge device which performs recording by spraying or discharging fluid (which includes liquid, a liquid matter which is formed in such a way that the particles of a functional material are dispersed or mixed in the liquid, a fluid matter such as gel, and solid which is capable of flowing as fluid and being discharged) other than the ink. Further, the printer 11 may include, for example, a liquid matter discharge device which performs printing by discharging a liquid matter including a material, such as an electrode material or a color material (pixel material), used to manufacture a liquid crystal display, an Electro-Luminescence (EL) display, and a surface light emitting display by dispersing or melting the material. In addition, the printer 11 may include a fluid matter discharge device which discharges the fluid matter, such as gel (for example, physical gel), or a powder matter discharge device (for example, toner jet type printing device) which discharges solid which includes power (powder matter), such as toner, as an example. Further, it is possible to apply the invention to any one type of the fluid discharge devices. Meanwhile, in the specification, the "fluid" does not include fluid which is formed of only gas, and the fluid includes, for example, liquid (which includes an inorganic solvent, an organic solvent, a solution, a liquid resin, a liquid metal (a metallic melt) or the like), a liquid matter, a fluid matter, a powder matter (which includes grains and powder), and the like.

The entire discovery of Japanese Patent Application No.: 2014-223664 and 2014-223665, filed Oct. 31, 2014 are expressly incorporated by reference herein.

What is claimed is:

1. A curl determination method comprising:

dividing a recording region of a medium, which includes four side edges, into a plurality of regions, and setting, as a determination region, a continuous region in which at least two of the plurality of regions are continued and which includes an end part region which is the closest region to a corner section, in which two side edges are connected, of the medium, the determination region being less than an entirety of the plurality of regions;

calculating an average value of liquid volume ratios only for the determination region, the calculating of the average value including calculating the average value of the liquid volume ratios of the at least two of the plurality of the regions, which have been set as the determination region, each of the liquid volume ratios of the at least two of the plurality of the regions being a ratio of the liquid, which is discharged from a recording section to each of the at least two of the plurality of the regions set as the determination region based on the discharge data of the liquid which is discharged from a recording section to the medium, to a maximum liquid volume of the liquid which is configured to be discharged from the recording section; and determining whether or not the average value of the liquid volume ratios, which are calculated only for the determination region, is larger than a predetermined threshold, and determining that curls are generated in the medium when determining that the average value is larger than the threshold.

2. The curl determination method according to claim 1, wherein the dividing and setting includes setting the plurality of determination regions in the recording region of the medium, and wherein the determining includes determining whether or not the largest average value of the average values of the liquid volume ratios of the liquid, which is discharged to the plurality of determination regions, is larger than the threshold.

3. The curl determination method according to claim 2, wherein the determination region is a region which is positioned in a fixed distance from the side edges in the recording region.

4. The curl determination method according to claim 3, wherein the driving and setting includes setting the determination region such that the determination region reaches over a center of the one side edge from the corner section side along at least one of the side edges.

5. The curl determination method according to claim 4, wherein the average value is a weighted average, and the weight is large as the region is close to the corner section.

6. The curl determination method according to claim 5, further comprising:

detecting temperature and humidity of the medium acquired before the recording is performed, wherein the determining includes performing determination using the threshold which is predetermined according to the detected temperature and humidity of the medium.

* * * * *